US006012473A

United States Patent [19]

Koyama

[11] Patent Number: 6,012,473

[45] Date of Patent: Jan. 11, 2000

[54] FLUID MIXER AND ROLLER CLEANER

[75] Inventor: Takehiko Koyama, Fushimi-Ku Kyoto 612-8427, Japan

[73] Assignee: Takehiko Koyama, Fushimi-KuKyoto, Japan

[21] Appl. No.: 09/044,378

[22] Filed: Mar. 18, 1998

[51] Int. Cl.[7] ..... B08B 3/00

[52] U.S. Cl. ..... 134/149; 134/900; 366/279; 366/343

[58] Field of Search ..... 134/149, 900; 366/279, 343

[56] References Cited

U.S. PATENT DOCUMENTS

| | | | |
|---|---|---|---|
| 1,954,093 | 4/1934 | Nelson | 366/343 |
| 4,077,082 | 3/1978 | Roe et al. | 15/230.11 |
| 4,263,055 | 4/1981 | Permar . | |
| 4,264,215 | 4/1981 | Nunlist et al. | 366/279 |
| 4,311,158 | 1/1982 | Harvey | 134/138 |
| 4,730,938 | 3/1988 | Dunn | 366/282 |
| 4,897,893 | 2/1990 | Barker | 15/230.11 |
| 5,289,731 | 3/1994 | Womack | 74/133 |
| 5,539,948 | 7/1996 | McCauley et al. . | |

FOREIGN PATENT DOCUMENTS

| | | | |
|---|---|---|---|
| 2670376 A1 | 1/1992 | France | 366/279 |
| 2 220 585 | 1/1990 | United Kingdom | 366/279 |

*Primary Examiner*—Frankie L. Stinson
*Assistant Examiner*—Paul J. Lee
*Attorney, Agent, or Firm*—Klarquist Sparkman Campbell Leigh & Whinston LLP

[57] ABSTRACT

A fluid mixer and roller cleaner is described. The device comprises a frame that can be sized to receive and retain rollers. The frame is operably, and perhaps removably, coupled to an elongated, power-driven shaft. The device further includes at least one mixing vane operably coupled to the elongated shaft. Typically, the frame is flexible in a spring-like manner to help retain the roller in a desired position about the frame. The diameter of the frame, as well as its length can be adjusted to accommodate rollers of different sizes. And, the frame members can be oriented so that the major planar surfaces thereof are substantially parallel to the longitudinal axis of the shaft, or at least one of the frame members can have its major planar surfaces canted relative to the major longitudinal axis of the elongated shaft. The frame, whether formed from plural frame members or a continuous sheath, may be of virtually any geometric shape. A currently preferred shape for the frame is substantially cylindrical. The frame members, or frame sheath, may further comprise mixing members in addition to the mixing vane removably or permanently coupled to the frame members. The frame sheath or frame members also may have first and second major planar surfaces wherein at least one of the major planar surfaces is textured.

24 Claims, 2 Drawing Sheets

FLUID MIXER AND ROLLER CLEANER

FIELD OF THE INVENTION

The present invention concerns an apparatus for mixing fluids and for cleaning rollers, such as paint rollers.

BACKGROUND OF THE INVENTION

Paint rollers are popular and economical tools used for quickly painting large, flat surfaces, such as walls and ceilings of buildings. Paint rollers generally include a handle and a "roller pad" or "brush." A paint roller brush is generally composed of a cardboard cylinder wrapped by bristled or spongy material capable of absorbing paint. The brush is mounted on a handle, dipped in a container (commonly an inclined pan) of paint to soak the brush, and rolled across the flat surface.

In recent years, water-based paints have become very popular. The number and prevalence of water-based latex and enamel paints has increased dramatically in response to consumer demands for alternatives to petroleum-based paints. Petroleum-based paints are poisonous, sometimes flammable, and environmentally hazardous. Water-based paints can be diluted in water, while petroleum-based paints can be diluted only with harsh petroleum distillates, such as turpentine or kerosene. Cleaning roller brushes that have been used to apply petroleum-based paints requires using these harsh petroleum distillates, which can harm the brush material and dissolve the glue or epoxy used to make the cardboard cylinders of the brushes. Brushes soaked in water-based paint can be cleaned using just water, but cleaning such brushes still can be difficult.

After use, brushes often are soaked in water, or other solvent. Brushes must be washed and rinsed by hand many times in order to remove all the paint. This cleaning process wastes solvent, time, and effort.

Devices have been developed for cleaning paint roller brushes. For example, Permar's U.S. Pat. No. 4,263,055 concerns a method for cleaning a paint roller pad using a device comprising an elongated coil having a shank connected thereto. The coil has an outside diameter less than that of certain roller pads so that the coil may be axially inserted into the bore of the pad. The coil radially expands and engages the roller pad to rotate the pad, which helps remove paint.

Although Permar's invention does radially expand during rotation, it still is designed to accommodate roller pads of only particular sizes. That is, if the diameter of a commercially available roller pad is less than that of the coil when the coil is at rest, then Permar's invention cannot be used with such rollers. Certain countries, particularly countries using the metric system, produce roller pads having bore diameters different from those used in the United States. Furthermore, if a particular roller pad is significantly longer or shorter than the length of the coil, then Permar's device also may have difficulty engaging the roller pad and/or rotating the roller pad to remove paint effectively.

McCauley et al.'s U.S. Pat. No. 5,539,948 concerns a paint roller cleaner adapter. McCauley's invention recognizes the problems of Permar's invention in so far as Permar's invention cannot be used with rollers having bore diameters significantly smaller than common roller pads. McCauley's invention is designed particularly for use with small rollers known as "weenie rollers" or "slim jims." But, McCauley's invention also is not size adjustable for accommodating rollers having diameters or lengths significantly larger than weenie rollers.

Japanese Patent No. 6-312463 describes an invention for cleaning paint roller brushes. A brush is mounted on a holder and rotated about the longitudinal axis of the cylinder. Paint is flung away from the brush as the brush rapidly spins about this axis by centrifugal force. This device is inefficient, and is designed solely as an apparatus for cleaning paint roller brushes.

Based on the above, it is clear that painters, and others using fluids similar to paint, need devices for cleaning roller pads after use. Prior inventions address only some of the needs of painters. As a result, painters still need new and improved roller-pad cleaners.

SUMMARY OF THE INVENTION

The present invention solves the problems associated with prior cleaning devices, and also combines this roller cleaning functionality with a fluid mixer. One embodiment of the device comprises a frame operably coupled to an elongated shaft having first and second ends. The frame is inserted into the bore of a roller brush. The diameter and length of the frame can be sized to receive and retain rollers having various lengths and bore diameters. The device further includes at least one mixing vane operably coupled, and typically removably coupled, to the elongated shaft.

A working embodiment of the device uses a frame having a plurality of elongated frame members. Each frame member has a first end and a second end, with each first end and second end being operably coupled to the shaft. An alternative embodiment has a plurality of elongated frame members, but each frame member terminates in first and second collars operably coupled to the shaft. Each collar defines an aperture for receiving the elongated shaft. Typically, the frame members are flexible. This allows the frame members to press outwardly in a spring-like fashion along an axis perpendicular to the major longitudinal axis of the elongated shaft to firmly engage a roller brush. This helps retain the roller brush in a desired position about the frame.

Furthermore, the frame members can be removably coupled to the elongated shaft by fasteners. With this embodiment, the frame members can be coupled to the shaft at any point along the shaft. This allows the length and diameter of the frame to be adjusted by changing the point at which the frame members are coupled to the shaft.

The frame members can be oriented so that the major planar surfaces thereof are substantially parallel to the longitudinal axis of the shaft. Alternatively, at least one of the frame members can be canted relative to the major longitudinal axis of the elongated shaft.

In an alternative embodiment, the frame may further comprise a first sub-assembly comprising a plurality of frame members, and a second sub-assembly comprising a plurality of frame members, each assembly being operably coupled to the shaft. With this embodiment, each of the frame members typically define apertures for receiving the elongated shaft, with the elongated shaft generally being inserted through the apertures of all frame members. And, the frame may further comprise a first sub-assembly comprising a plurality of frame members, and a second sub-assembly comprising a plurality of frame members, each member having a first end and a second end, with each first end terminating in a first collar and each second end terminating in a second collar, each subassembly being operably connected to the shaft. These subassemblies can be connected, or the first and second sub-assemblies can be entirely independent. The frame also may comprise three or more sub-assemblies, with the subassemblies being entirely independent of one another, or any two or more of the subassemblies can be connected.

The frames described above typically include plural frame members. But, the frame also may comprise a continuous sheath that surrounds and encloses at least a portion of the elongated shaft.

The frame, whether formed from plural frame members or a continuous sheath, may be of virtually any geometric shape. A currently preferred shape for the frame is substantially cylindrical.

The frame members, or frame sheath, may further comprise mixing members in addition to the mixing vane. These mixing members may be removably or permanently coupled to the frame members and/or the shaft. The frame sheath or frame members also have first and second major planar surfaces. The device can have at least one of the major planar surfaces textured.

A currently preferred embodiment of the present device for mixing fluids and cleaning rollers comprises an elongated power driven shaft having first and second ends. The second end of the shaft is operably coupled to an electric motor, such as an electric drill. A frame is operably coupled to and encloses at least a portion of the elongated shaft. Although the frame can be a continuous sheath, the currently preferred frame comprises a plurality of frame members, each frame member having first and second ends, each end being coupled to the elongated shaft. At least one of the frame members typically is canted relative to the major longitudinal axis of the elongated shaft. The device also includes at least one mixing vane operably coupled to the shaft, the vane comprising blades radiating outwardly from the shaft.

The present invention also provides a method for cleaning rollers. The method comprises providing a device substantially as described above. The frame of the device is first sized to accommodate the length and bore diameter of a roller brush. The correctly sized frame is then inserted into the bore of a roller brush, and the power-driven shaft is coupled to a power source such as, for example, an electric drill. The roller brush is then rotated by actuating the power source.

DETAILED DESCRIPTION OF THE PREFERRED EMBODIMENTS

Figure 1:
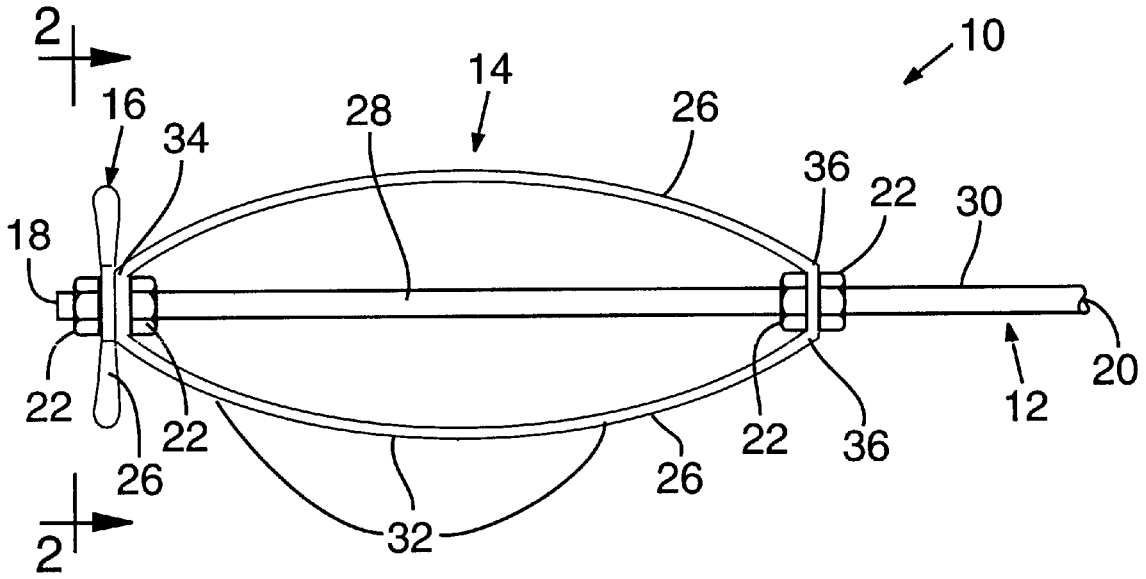
FIG. 1 is a side view illustrating one embodiment of the present invention.

The present invention concerns a device 10 for mixing fluids and/or cleaning rollers. Device 10 has three main parts: an elongated power-driven shaft 12, a frame 14, and at least one mixing vane 16.

The device 10 can be made from a variety of materials. For example, device 10 can be made from metals or metal alloys, such as aluminum or aluminum alloys, or from plastics, particularly thermoset plastics. Alternatively, device 10 can be made from plural different materials, including a combination of plastic material and metal or metal alloy.

The elongated shaft 12 of the invention has a first end 18 and a second end 20. Adjacent to the first end 18, mixing vane 16 is coupled to the shaft 12. Plural fasteners, such as two threaded nuts 22, couple the vane 16 to the shaft 12.

Mixing vane 16 can be one of any variety of shapes. In a working embodiment, mixing vane 16 includes plural blades 26, which radiate outwardly from the shaft 12. Blades 26 have two major opposed surfaces, with the major planar surfaces of each blade 26 canted to an axis transverse to the major longitudinal axis of the shaft 12. In one embodiment, the vane 16 resembles a propeller. Alternative embodiments of the invention include (but are not limited to) devices having different types of mixing vanes 16. Device 10 also can include plural mixing vanes 16, such as two propeller-type mixing vanes 16 coupled to the shaft 12.

Mixing vanes 16 either may be removably coupled to the shaft 12 or permanently coupled (glued, welded, etc.) to the shaft 12. In the current embodiment, shaft 12 is threaded, and the mixing vane 16 is threadedly coupled to the shaft 12.

Frame 14 is coupled to the shaft 12 and substantially surrounds and encloses a portion of the shaft 28. This leaves a portion 30 of the shaft 12 adjacent to the second end 20 that is not enclosed by frame 14. Portion 30 of the shaft 12 is designed to be operably coupled to a power source, such as an electric motor.

As illustrated in FIG. 1, a working embodiment of frame 14 includes plural elongated frame members 32. Each frame member 32 has a first end 34 and a second end 36. A current embodiment of device 10 has four elongated frame members 34 spaced equally around the frame 14.

In the illustrated embodiment, elongated frame members 32 are flexible and can bend inwardly and outwardly away from the shaft 12 along an axis transverse to the major longitudinal axis of the shaft 12. The diameter of the frame 14, measured at its widest point, is sized to be just slightly larger than the interior diameter of a roller brush bore. The diameter of the frame 14, as defined by the elongated frame members 32, cannot be significantly larger or significantly smaller than the interior diameter of a roller. If the diameter of the frame 14 is significantly larger, the frame 14 would be unable to receive the roller. If the diameter of the frame 14 is significantly smaller than that of the roller, the frame 14 would be unable to retain the roller.

The frame members 32 can be coupled to the shaft 12 in several ways. For example, in the embodiment illustrated in FIGS. 1–2, frame members 32 are operably coupled directly to the shaft 12. Frame members 32 define apertures 42. See, FIG. 3. Shaft 12 is inserted through each aperture 42 of each frame member 32. Frame members 32 are secured in position relative to shaft 12 with fasteners, such as nuts 22.

Figure 5:
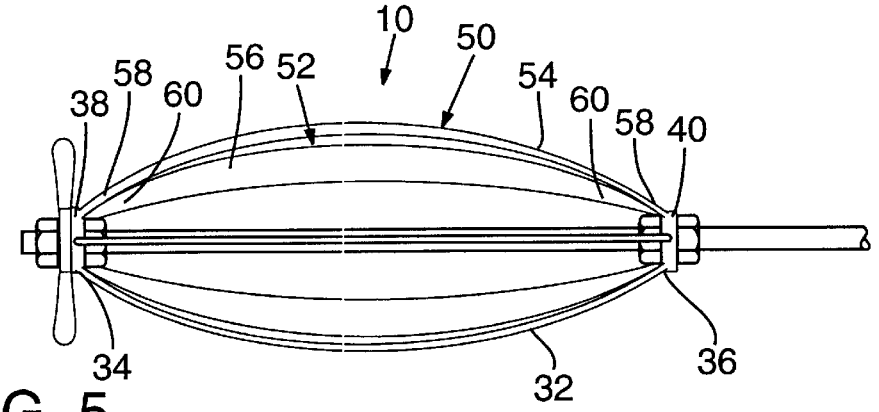
FIG. 5 is a side view of an alternative embodiment of the invention.

Alternatively, and as illustrated in FIG. 5, another embodiment of device 10 has the first ends 34 of each frame member 32 terminating in a first collar 38, with the second ends 36 of each frame member 32 terminating in a second collar 40. Ends 34 and 36 of the frame members 32 are coupled, such as by welding, to collars 38 and 40. Collars 38 and 40 are threadedly coupled directly to the shaft 12.

Figure 6:
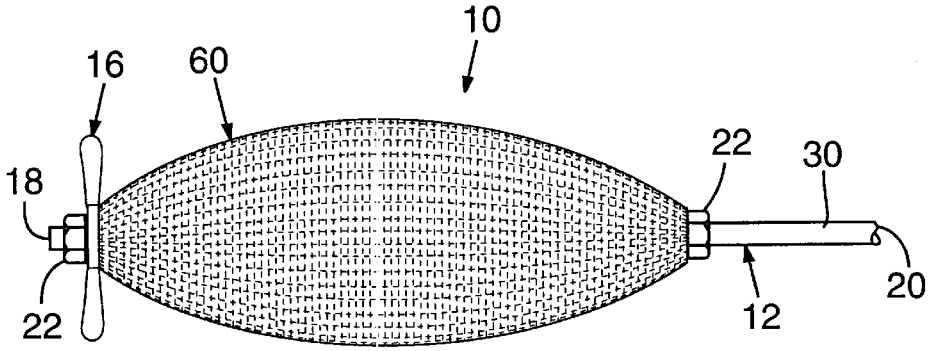
FIG. 6 is a side view of an alternative embodiment of the invention.

Alternatively, the entire frame can be formed as one continuous piece, instead of using elongated frame members 32 to define the frame, such as frame 60 illustrated in FIG. 6. Frame 60 is substantially cylindrically shaped from a single, continuous piece of material, such as aluminum or a thermosetting plastic.

Furthermore, in the embodiments illustrated in FIGS. 1 and 5, frame member ends 34 and 36 may be coupled to shaft 12 at any point along the shaft 12. Thus, the distance between ends 34 and 36, as well as the degree to which the frame members 32 bend outwardly away from the longitudinal axis of shaft 12, can be adjusted. This in turn changes the length and diameter of frame 14 to adjust the size of the frame 14 to fit a given roller. The degree of bending can be adjusted by moving the first ends 34 of each frame member 32 closer to or farther from the second ends 36 of the frame members 32. For example, in the illustrated embodiment, if the diameter of the frame 14 is too small to retain the roller, then fasteners 22 securing the second ends 36 of the frame members 32 are moved closer to the fasteners 22 securing the first ends 34 of the frame members 32 and the mixing vane 16. This increases the degree of outward bending of the frame members 32. If the diameter of the frame 14 is too large to receive a roller, the fasteners 22 securing the second ends 36 of the elongated frame members 32 to the shaft 12 are moved farther from the fasteners 22 securing the first ends 34 of the frame members 32 and the mixing vane 16 to the shaft 12.

Figure 7:
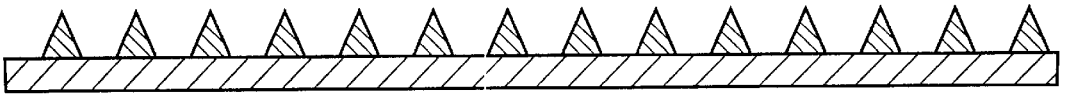
FIG. 7 is a side view of a frame member having a textured surface.

The frame members 32 described above generally include substantially flat, continuous surfaces. However, frame members 32 also might be perforated or textured. One example of a frame member 32 having a "textured" surface is illustrated by FIG. 7. As used herein, "textured" refers to any non-smooth surface. The textured surface provides several advantages, such as increasing fluid mixing upon rotation of the device 10, or to better retention of the rollers about the frame 14.

Figure 4:
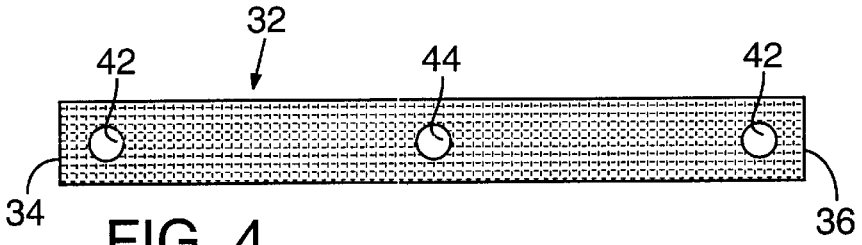
FIG. 4 is a plan view of an alternative frame member.

Alternatively, frame members 32 can be formed into loops of flexible material with three apertures: apertures 42 at the first end 34 and at the second end 36, and a third aperture 44 located substantially intermediate the first end 34 and second end 36. See, FIG. 4. This effectively creates two frame members 32 from one continuous work piece. The end apertures 42 are brought together, overlapped and aligned. The shaft 12 is then inserted through the aligned apertures 42, as well as the aperture 44 in the middle of the member 32.

The frame members 32 do not necessarily have to bend outwardly away from the shaft. An alternative embodiment would have a frame 14 where the frame members 32 run substantially parallel to the shaft 12 and define a frame 14 having a diameter sufficient to receive and retain most commercially available rollers. One advantage of a frame 14 with flexible frame members 32 is realized when the invention is used with a number of different types of rollers. Since the interior diameter of roller bores often vary, the flexible frame members 32 act like springs that flex outwardly from the longitudinal axis of the shaft 12 and ensure that the frame 12 is capable of receiving and retaining a number of different types and sizes of rollers. Without this spring-like feature, each roller requires using a differently sized frame 14.

Figure 2:
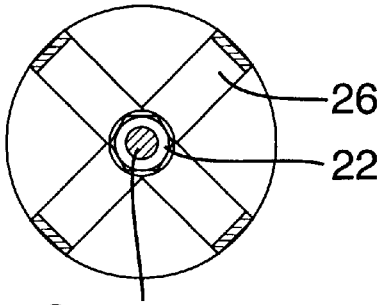
FIG. 2 is a cross-sectional end view of the embodiment illustrated in FIG. 1 taken along line 2–2'.
Figure 3:
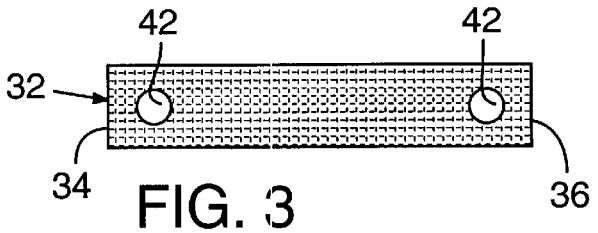
FIG. 3 is a plan view of one frame member.

The frame 14 can be comprised of a single assembly, as illustrated in FIGS. 1 and 2, or using a first subassembly 50 and a second subassembly 52, as illustrated in FIG. 5. In an embodiment having two sub-assemblies 50 and 52, elongated frame members 54 form the first sub-assembly 50 and frame members 56 form second sub-assembly 52. Ends 58 of the frame members 54 and ends 60 of frame members 56 are coupled to the shaft 12 using collars 38 and 40. The frame sub-assemblies 50 and 52 can be independently coupled to the shaft 12, or dependently coupled together. For example, in the embodiment illustrated in FIG. 5, each sub-assembly 50 and 52 can be independently coupled to the shaft 12, or first can be coupled together and then coupled to the shaft 12. Alternative embodiments of the invention include three or more frame sub-assemblies.

In an embodiment having two (or more) sub-assemblies, such as subassemblies 50 and 52, different types of frame members 54 and 56 can be used. For example, the frame members 54 of one sub-assembly might be optimized for mixing (such as by canting, as described below) while the frame members 56 of the other assembly might be optimized for receiving and retaining rollers.

In addition to receiving and retaining rollers, the frame members 32, 54 and/or 56 can provide additional mixing forces for mixing fluids. In one embodiment, the major planar surfaces of all of the frame members comprising the frame 14 are canted relative to the major longitudinal axis of the elongated shaft 12. As a result, the frame 14 takes on a spiral or helical shape. Canting frame members 32, 54 or 56 makes available more surface area of the frame members for mixing a fluid. If a frame 14 is rotated in a fluid, the major planar surfaces of non-canted frame members are positioned parallel to the direction of rotation, while the major planar surfaces of canted frame members are positioned at angles transverse to the direction of rotation.

Canting frame members 32, 54 and/or 56 provides mixing forces in addition to the mixing forces generated by a mixing vane. Furthermore, the additional mixing forces generated by canted frame members are directed substantially transverse to the mixing forces generated by a mixing vane 16. The mixing forces generated by a mixing vane 16 run mostly parallel to the major longitudinal axis of the elongated shaft, while the mixing forces generated by rotating canted frame members 32, 54 and/or 56 run transverse to this major longitudinal axis.

The frame members may be perforated or textured, in addition to or instead of being canted, to provide additional mixing forces.

The alternative embodiment of the invention illustrated in FIG. 6 employs a frame 60 comprised of a continuous sheath of material, rather than a frame 14 comprised of multiple frame members 32. Sheath frame 60 provides substantially greater surface area for retaining rollers, thus allowing, for example, faster rotating speeds for cleaning rollers. Sheath frame 60 could be fashioned into a variety of desired shapes including, without limitation, cylindrical, rectangular, spherical, ovoid, or virtually any other three dimensional shape. The diameter of the sheath frame 60 can be altered to receive and retain different rollers having different interior diameters. The sheath also can be textured or perforated to better retain a roller, or to better mix particular fluids.

The frame—whether comprised of frame members or a continuous sheath—also can include mixing members. These mixing members provide greater surface area for contact with the fluid being mixed, and thus generate greater mixing forces. These additional mixing members may be permanently or detachably coupled to the frame, and can be sized and shaped in a variety of ways, such as small fins, half-circles, extended rods, triangles, dome-shaped nubs, flagellae, etc.

The portion 30 of the elongated shaft 12 not surrounded or enclosed by the frame 14 is free for coupling to a motor or engine for rotating the shaft 12 and frame 14. For example, the open portion 30 of the shaft 12 might be clamped in the drive chuck of an electric drill. Alternatively, the invention can be coupled to a motor, or handgrips.

Once some method of rotating the invention is established, the device 10 with roller attached is then lowered into a bucket or under a stream of water for cleaning. Alternatively, device 10 without a roller can be used to mix a quantity of fluid, such as a bucket of paint.

The current embodiment of the invention is especially well suited for use by professional house painters using water-based paints. These painters first use the invention to mix industrial-size, multi-gallon buckets of paint. Device 10 is coupled to a portable drill and used to quickly mix several buckets of paint. In cleaning up after painting, the painters use this same invention to quickly and easily clean paint rollers they used. Rather than soaking such rollers for an extended period of time, the painters simply place a roller on the device 10 and rotate the roller under a stream of water or in a bucket of water. Once a particular roller is cleaned, the painters remove that roller and place another device 10 to be cleaned.

The present invention has been described with respect to certain preferred embodiments. The present invention should not be limited to the particular features described. Instead, the scope of the invention should be determined by the following claims.

I claim:

1. A device, comprising:

a frame operably coupled to an elongated power-driven shaft, the elongated shaft having first and second ends, the frame having a length and diameter that can be sized to receive and retain rollers, the frame comprising a plurality of elongated frame members, each frame member having a first and second end, with each first end and each second end being operably coupled to the shaft, the frame members being flexible and bending outwardly from the shaft along an axis perpendicular to the major longitudinal axis of the elongated shaft; and at least one mixing vane operably coupled to the elongated shaft.

2. The device according to claim 1 wherein the at least one mixing vane is removably coupled to the elongated shaft.

3. The device according to claim 1 wherein the at least one mixing vane is threadedly coupled to the elongated shaft adjacent to the first end.

4. The device according to claim 1 wherein plural mixing vanes are threadedly coupled to the elongated shaft.

5. The device according to claim 1 wherein the frame comprises a plurality of elongated frame members, each frame member having a first end and a second end, with each first end and each second end being operably coupled to the shaft, the frame members defining apertures for receiving the elongated shaft.

6. The device according to claim 1 wherein the frame comprises a plurality of elongated members, each member having a first end and a second end, with each first end terminating in a first collar and each second end terminating in a second collar, each collar defining an aperture for receiving the elongated shaft.

7. The device according to claim 6 wherein the first and second collars are removably coupled to the elongated shaft by fasteners at any point along the elongated shaft.

8. The device according to claim 7 wherein the collars are threadedly coupled to the elongated shaft.

9. The device according to claim 1 wherein the second end of the elongated shaft is designed to be operably coupled to a motor for rotating the shaft.

10. The device according to claim 1 wherein the frame members are removably coupled to the elongated shaft by fasteners, with the fasteners being movable along the length of the shaft for coupling to any point along the elongated shaft.

11. The device according to claim 1 wherein the frame members have first and second major planar surfaces, at least one of the frame members having its major planar surfaces canted relative to the major longitudinal axis of the elongated shaft.

12. A device according to claim 1 wherein the frame comprises a continuous sheath surrounding and enclosing at least a portion of the elongated shaft.

13. A device according to claim 12 wherein the sheath has a first end and a second end, the first end terminating in a first collar, the second end terminating in a second collar, each of the collars defining apertures for receiving the elongated shaft, the first and second collars being removably coupled to the elongated shaft by fasteners capable of coupling to any point along the elongated shaft.

14. A device according to claim 12 wherein the continuous sheath is substantially cylindrical.

15. A device according to claim 1 wherein the frame members further comprise mixing members.

16. A device according to claim 15 wherein the mixing members are removably coupled to the frame members.

17. The device according to claim 1 wherein the at least one mixing vane comprises blades radiating outwardly from the shaft, each blade having at least two major planer surfaces, at least one of the blades being canted to the axis transverse to the major longitudinal axis of the shaft.

18. A device, comprising:

a frame operably coupled to an elongated power-driven shaft, the elongated shaft having first and second ends, the frame having a length and diameter that can be sized to receive and retain rollers, the frame comprising a first sub-assembly comprising a plurality of frame members, each member having a first end and a second end operably coupled to the shaft, and a second sub-assembly comprising a plurality of frame members, each member having a first end and a second end operably coupled to the shaft; and at least one mixing vane operably coupled to the elongated shaft.

19. The device according to claim 18 wherein each of the frame members define apertures for receiving the elongated shaft.

20. The device according to claim 18 wherein the first and second sub-assemblies are independent.

21. The device according to claim 18 wherein the frame comprises three or more sub-assemblies.

22. A device, comprising:

a frame operably coupled to an elongated power-driven shaft, the elongated shaft having first and second ends, the frame having a length and diameter that can be sized to receive and retain rollers, the frame comprising a first sub-assembly comprising a plurality of frame members, each member having a first end and a second end, with each first end terminating in a first collar and each second end terminating in a second collar, and a second sub-assembly comprising a plurality of frame members, each member having a first end and a second end, with each first end terminating in a first collar and each second end terminating in a second collar; and at least one mixing vane operably coupled to the elongated shaft.

23. A device, comprising:

a frame operably coupled to an elongated power-driven shaft, the elongated shaft having first and second ends, the frame having a length and diameter that can be sized to receive and retain rollers, the frame comprising a plurality of elongated frame members, each frame member having a first end and second end, with each first end and each second end being operably coupled to the shaft, the frame members having first and second major planar surfaces wherein at least one of the major planar surfaces is textured; and at least one mixing vane operably coupled to the elongated shaft.

24. A device for mixing fluids and cleaning rollers, comprising:

an elongated power driven shaft having first and second ends, the frame having a length and diameter that can be sized to receive and retain rollers, the second end being operably coupled to a motor;

a frame operably coupled to and enclosing at least a portion of the elongated shaft, the frame comprising a plurality of frame members, each frame member having a first end and a second end coupled to the elongated shaft, each frame member having first and second major planar surfaces, wherein at least one frame member has its major planar surfaces canted relative to the major longitudinal axis of the elongated shaft; and at least one mixing vane operably coupled to the first end of the elongated shaft, the mixing vane comprising blades radiating outwardly from the shaft, each blade having at least two major planar surfaces, at least one of the blades having its major planar surfaces canted to the axis transverse to the major longitudinal axis of the shaft.

* * * * *

UNITED STATES PATENT AND TRADEMARK OFFICE

CERTIFICATE OF CORRECTION

PATENT NO. : 6,012,473
DATED : January 11, 2000
INVENTOR(S) : Takehiko Koyama

It is certified that error appears in the above-identified patent and that said Letters Patent is hereby corrected as shown below:

Column 7,
Line 58, "claim 7" should read -- claim 6 --.

Signed and Sealed this

Nineteenth Day of February, 2002

*Attest:*

*Attesting Officer*

JAMES E. ROGAN
*Director of the United States Patent and Trademark Office*